US005788115A

United States Patent [19]

Halliburton

[11] Patent Number: 5,788,115

[45] Date of Patent: Aug. 4, 1998

[54] ARTICLE DISPENSER WITH RANDOM BONUS

[75] Inventor: Ronald D. Halliburton, Delray Beach, Fla.

[73] Assignee: Benchmark Entertainment L.C., Pompano Beach, Fla.

[21] Appl. No.: 869,893

[22] Filed: Jun. 5, 1997

[51] Int. Cl.[6] ..... A47F 1/04

[52] U.S. Cl. ..... 221/155; 312/45

[58] Field of Search ..... 221/155, 67, 130, 221/124, 131, 92, 97, 191, 208, 289; 312/36, 45, 72

[56] References Cited

U.S. PATENT DOCUMENTS 5,392,953 2/1995 Maldanis et al. ..... 221/155

5,452,822 9/1995 Haymond ..... 221/155

*Primary Examiner*—Kenneth Noland

*Attorney, Agent, or Firm*—Lane, Aitken & McCann

[57] ABSTRACT

An article dispensing device including a cabinet defines a dispensing path viewable from outside the cabinet and a plurality of randomly operating elements for possibly diverting an article travelling along the path. A bonus article is dispensed if a primary article successfully negotiates the dispensing path without being diverted. The average rate of operation of the diverting device increases with each diverting device encountered by the article along the dispensing path. For each diverting device, the average rate of operation is greater when an article nears than at other times.

11 Claims, 4 Drawing Sheets

ARTICLE DISPENSER WITH RANDOM BONUS

BACKGROUND OF THE INVENTION

The present invention relates to an article vending machine and, more particularly, to an article vending machine which awards a bonus article on a random basis.

SUMMARY OF THE INVENTION

By the present invention, articles are dispensed from a vending machine in an entertaining manner by a viewable hit-or-miss sequence through which a first article is definitely dispensed and one or more additional articles are possibly dispensed.

In one embodiment, the invention comprises a machine which vends generally spherical articles, such as gum balls, and for each article which successfully negotiates a path from which the article might be diverted, awards a second, bonus article, such as another gum ball. The article might be diverted by one or more elements traversing the path in a random fashion, by which the article might be diverted by collision with one o the traversing elements. The bonus article is also set on a path from which it might be diverted, which can be the same path the first article negotiated. If the second article also successfully negotiates its path, another bonus article can be awarded by setting it on a path from which it might be diverted, and so on, conceivably until all of the articles in the machine are dispensed. Each article which is set upon a path is dispensed, whether or not it is diverted. However, if an article is diverted from its path, no further article is set upon a path.

In the disclosed embodiment, the path is defined by a series of inclined ramps, arranged one below the other, and the traversing elements are mounted on randomly reciprocating solenoids. If a traversing element intersects a ramp when an article is in the path of the traversing element, the article is knocked off the supporting ramp, from which it falls to a dispensing outlet. If, instead, the article successfully negotiates all of the ramps, it is detected by a sensor, which actuates a sound effect and separates another article from a supply of articles in the machine. The series of ramps and the randomly operating traversing elements are viewable through a window to provide suspense and excitement for those viewing the dispensing operation.

DETAILED DESCRIPTION OF THE PREFERRED EMBODIMENT

Figure 1:
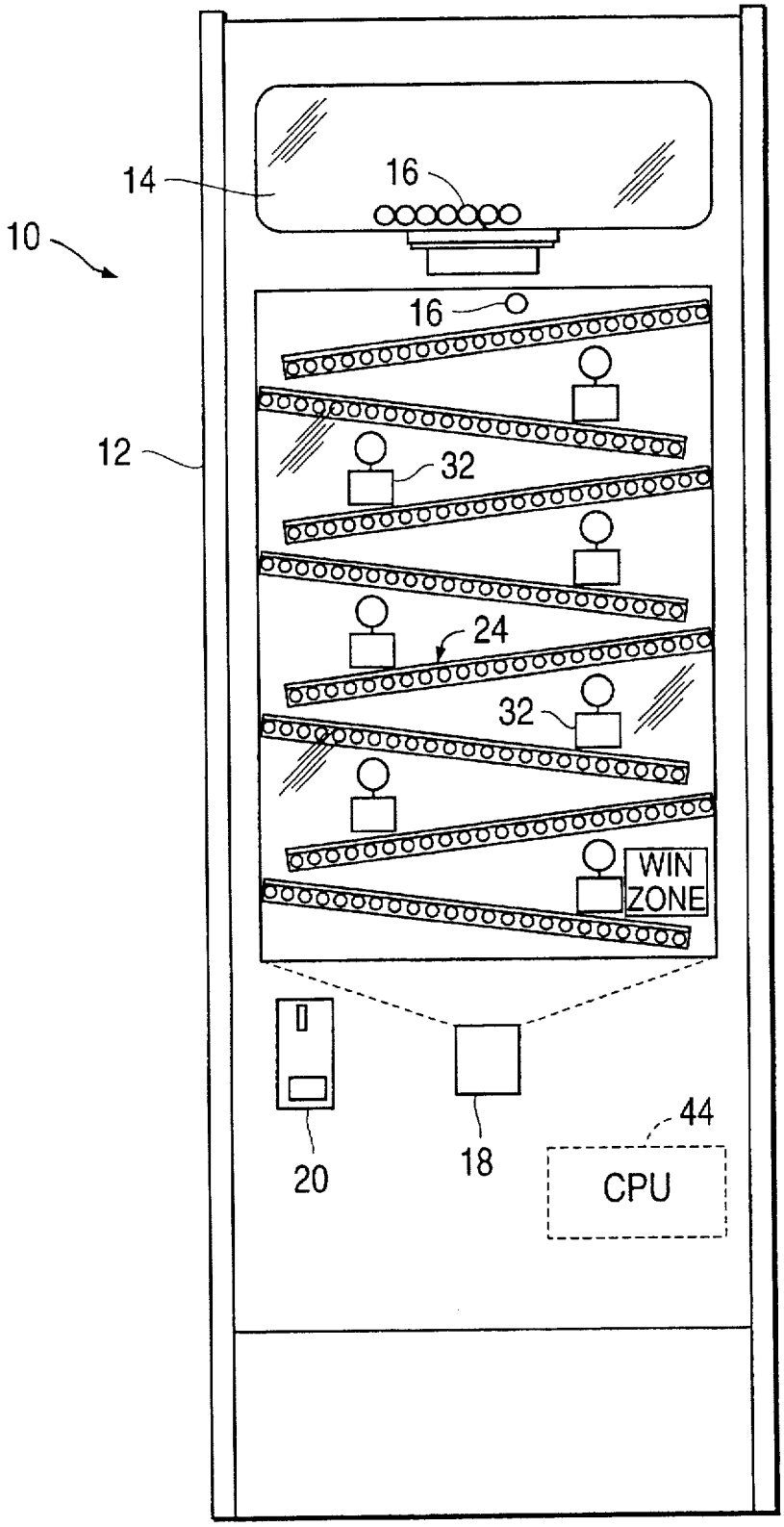
FIG. 1 is a front elevation of a vending machine embodying the article dispenser of the present invention.

As can be seen from FIG. 1, the article dispenser according to the present invention, which is designated generally by the reference numeral 10, can be embodied in a vending machine comprising a cabinet 12, a hopper 14 containing a supply of generally spherical articles 16, such as gum balls, and a dispensing outlet 18. As can be appreciated from FIGS. 1 and 2, a currency acceptor 20 for receiving coins, other tokens, or bills is operatively connected to a conventional device for separating an article 16 from the supply of articles in the hopper 14 and transferring the separated article to a starting point on a dispensing path, indicated generally by the reference numeral 24.

The conventional device can comprise, for example, a rotary trap chamber hopper wheel 22 positioned at the bottom of the hopper 14 and rotatable about a vertical axis. The hopper wheel 22 receives articles 16 from above, and is indexed by a hopper motor 17 (FIG. 4) to move a chamber in the wheel 22 into alignment with a passage 26 to drop an article into the dispensing path 24 below.

Figure 2:
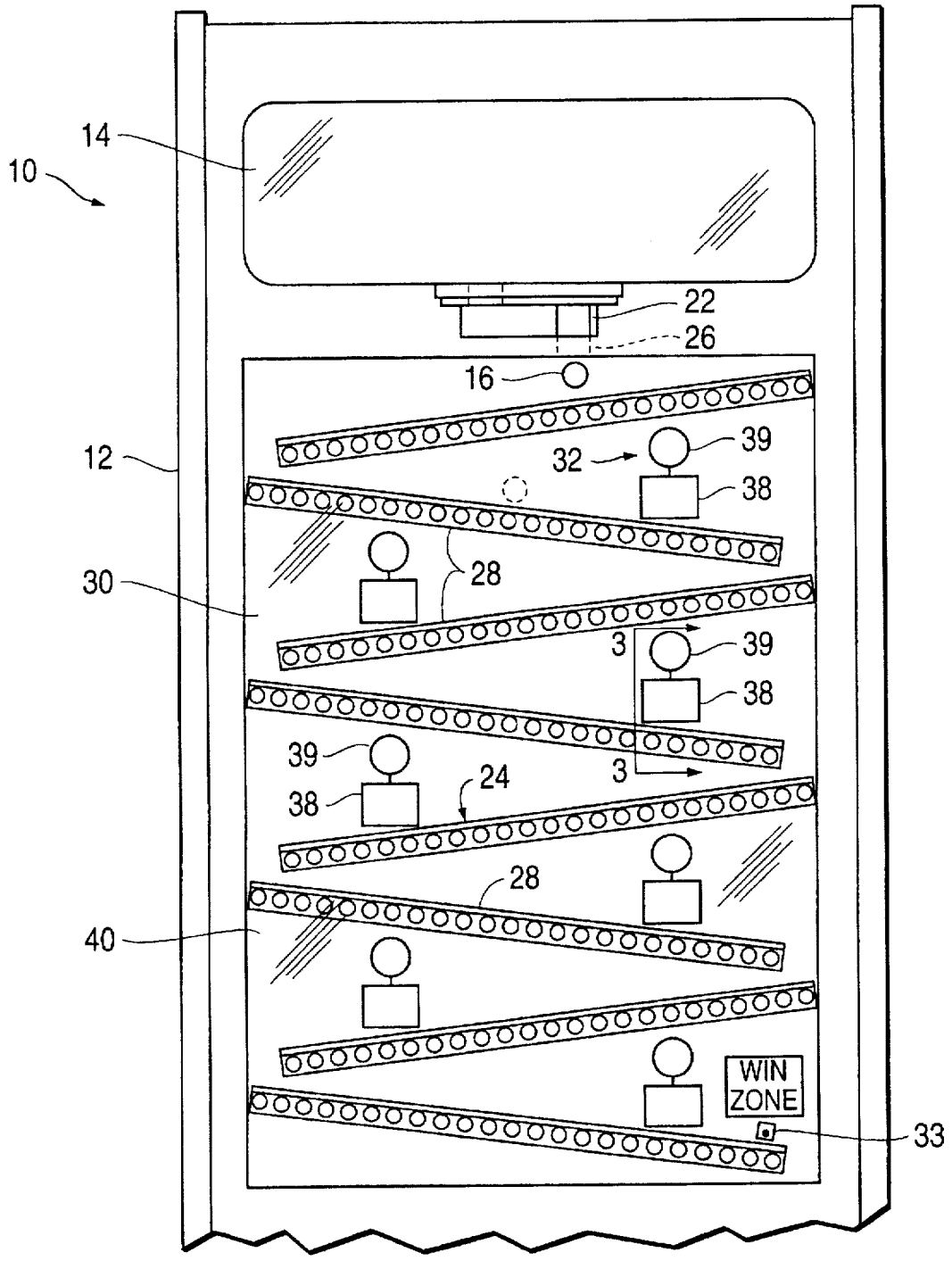
FIG. 2 is an enlarged front elevation of an upper portion of the vending machine of FIG. 1.
Figure 3:
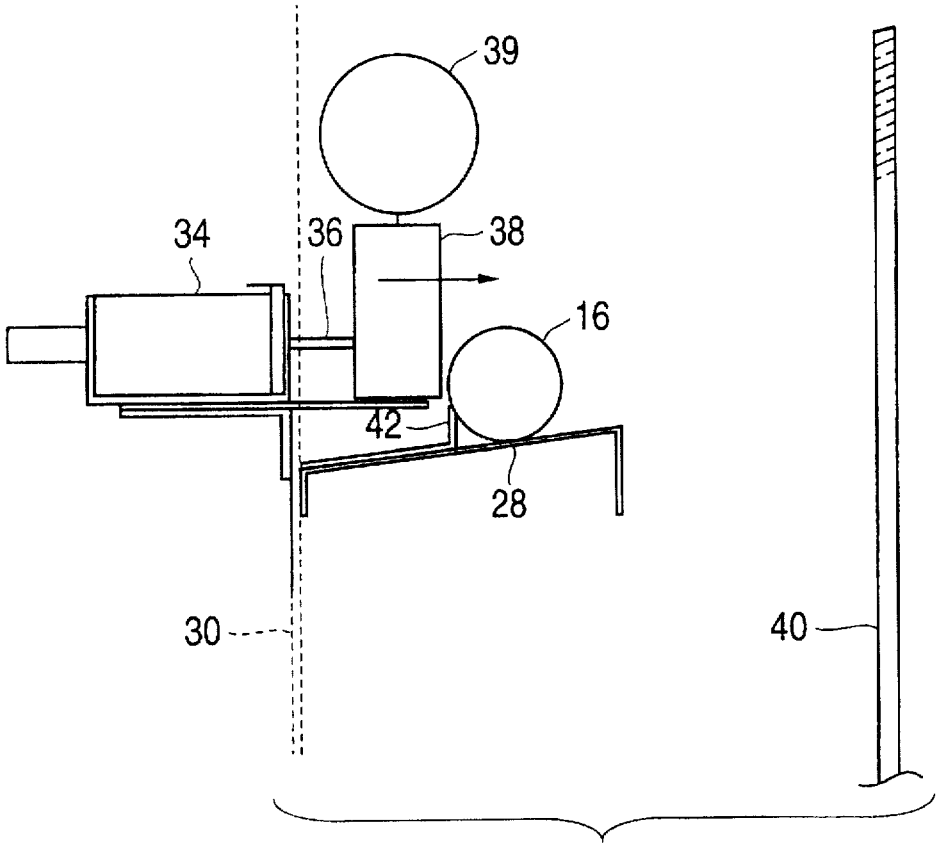
FIG. 3 is a schematic cross-section, taken along the line 3—3 of one of the ramps of the vending machine of FIG. 2.

As can best be seen from FIGS. 2 and 3, the dispensing path 24 is defined by a series of inclined ramps 28. The ramps 28 are generally in vertical alignment with one another, but the lower end of each ramp terminates at a point horizontally short of the upper end of the next ramp. Every other ramp 28 is inclined in a first direction, and alternate ramps 28 are inclined in a second direction opposite to the first direction.

A plurality of article diverters 32 are mounted on the panel 30, one of the diverters being positioned along each of the inclined ramps 28, except that no article diverter 32 is positioned along the top or first ramp 28 in the embodiment shown. Each article diverter 32 includes a solenoid 34 having a plunger 36 and a reciprocating element 38 mounted on the plunger. A decorative element 39 can be spring mounted on the reciprocating element 38. When the plunger 36 is extended, the reciprocating element 38 intersects a portion of the dispensing path 24 defined by the adjacent inclined ramp 28, so that if a spherical article 16 is on the adjacent ramp 28 and in alignment with the reciprocating element 38 when the plunger 36 extends, the reciprocating element 38 knocks the article 16 off the ramp 28. As a result, the article 16 falls between the ramp 28 and a pane 40 of glass on the front of the cabinet 12 to the dispensing outlet 18, where the article can be removed. A reciprocating movement of ½ inch by the reciprocating element 38 has been found to be suitable.

It can be appreciated from FIG. 3 that the ramps 28 are sloped toward the panel 30, for example, a slope of about 7°, and that a rail 42 guides the articles 16 on the panel side of the articles. As a result, the articles 16 are prevented from rolling forward or rearward off the ramps 28. It can also be appreciated that the hopper wheel 22, the ramps 28 and other elements can be constructed to handle disc-shaped articles, such as coins.

If an article 16 is not knocked off of a ramp 28 by a diverter 32, the article rolls under the influence of gravity to the end of that ramp and falls to the upper end of the next ramp in the series, and so on. If an article 16 is not knocked off any of the inclined ramps 28, it reaches the end of the dispensing path 24, where its presence is detected by a sensor 33. The sensor 33 can be a switch, which can be called a "win" switch, having an actuating element extending into the dispensing path 24 of the article 16 downstream of the last diverter 32. The detected article 16 then falls to the dispensing outlet 18. Any article 16 which passes the last diverter 32 strikes the actuating element of the sensor 33 as the article rolls by the actuating element.

In response to the detection, the sensor 33 causes the hopper motor 17 controlling the hopper wheel 22 to set a second article 16 upon the dispensing path 24. If the second article 16 reaches the end of the dispensing path 24 without being diverted, the sensor 33 detects it and causes a third article to be set upon the dispensing path. The second article 16 then falls to the dispensing outlet 18. Theoretically, this sequence can continue until all of the articles 16 in the hopper 14 are dispensed. However, the timing of the traversal of the dispensing path 24 by the reciprocating element 38 is arranged to avoid the successful negotiation of the dispensing path 24 by a large number of successive articles.

Figure 4:
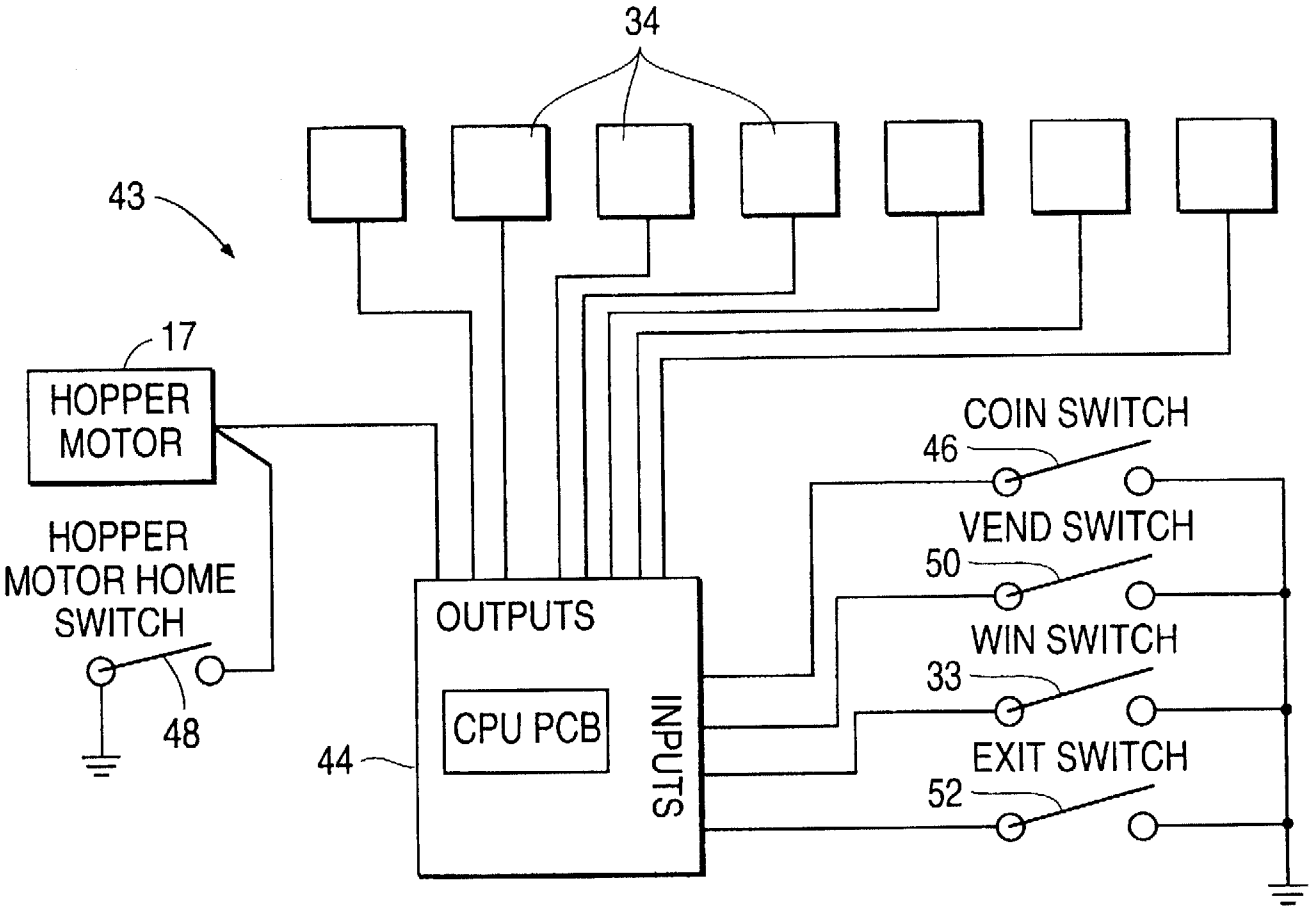
FIG. 4 is a schematic showing of a control system for the vending machine.

As can be appreciated from FIG. 4, the operation of the article dispenser 10, including the operation of the article diverters 32, is controlled by a control system 43 based on a central processing unit (CPU) 44 in the cabinet 12. The CPU 44 is operatively connected to the solenoids 34 to cause the solenoids, and therefore the reciprocating elements 38, to traverse the ramps 28 at random times. The first article diverter 32 along the dispensing path 24 has a reciprocating element 38 which crosses the adjacent ramp 28 at random times which define an average rate of traversal. The reciprocating element 38 of each subsequent article diverter 32 along the dispensing path 24 crosses the adjacent ramp at random times and at a higher average rate of traversal than the reciprocating element of the preceding article diverter 32. As a result, the probability that a reciprocating element 38 will divert an article 16 from the dispensing path increases from each reciprocating element to the next. Furthermore, based upon a predetermined general time for a spherical article 16 to reach each article diverter 32, the CPU 44 is programmed to cause a reciprocating element 38 to cross the dispensing path 24 at a higher average rate of traversal when the spherical article nears the reciprocating element than at other times. With respect to articles which are not precisely spherical, such as gum balls, some roll better than others. Thus, some such articles reach the reciprocating elements 38 faster than others, thereby increasing the randomness of the traversal of the reciprocating element 38 relative to the position of the articles. The dispensing sequence is visible through the pane 40 so as to be entertaining to onlookers. More specifically, the dispensing sequence provides a sense of risk, suspense and excitement similar to that of a race.

Operation of the article dispenser 10 is initiated by the insertion of the proper coin or the like in the currency acceptor 20, which closes a coin switch 46, which in turn provides the proper input to the CPU 44 to rotate the hopper motor 17 one revolution. A cam on the hopper motor closes a hopper motor home switch 48 to assure that the hopper motor 17 turns one revolution. The hopper wheel 22 turns one revolution with the hopper motor 17, thereby transferring one article 16 from the hopper 14 to the passage 26, from which the article falls to the first ramp 28. A vend switch 50 adjacent to the passage 26 is actuated by a passing article 16 to provide an appropriate input to the CPU 44 and thereby prevent further rotation of the hopper wheel 22. Without this input, the CPU 44 causes the hopper wheel 22 to turn another revolution. Accordingly, the vend switch 50 assures that an article 16 is transferred as a result of a revolution of the hopper wheel 22. In a similar manner, an exit switch 52 is positioned along an exit passage to the dispensing outlet 18 to assure that an article 18 reaches the dispensing outlet. An article 16 passing the exit switch 52 closes the switch and causes an input to the CPU 44 to prevent the hopper wheel 22 from turning another revolution. Absent this input, the hopper wheel 22 does turn another revolution to dispense an article 16.

An article 16 which successfully negotiates all of the ramps 28 closes the "win" switch comprising the sensor 33, thereby providing an input to cause the CPU 44 to rotate one revolution and transfer another article 16 from the hopper 14 to the dispensing path 24. Closing the "win" switch also causes a sound effect to occur. If desired, a manually operable switch can be included to provide the option of eliminating the actuation of the sound effect.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. An article dispensing device comprising:

an enclosure;

a source of articles in the enclosure, said articles being movable by gravity along a path from a starting point to an end point;

means for enabling viewing of said path from outside the enclosure;

means for transferring one of the articles from said source to said starting point of said path;

means for possibly diverting said transferred article from said path such that the article does not reach the end point;

means for delivering said transferred article outside the enclosure;

means for sensing arrival of said transferred article at said end point; and means responsive to said sensing means for delivering a second article from inside the enclosure to outside the enclosure.

2. The article dispensing device of claim 1, wherein at least some of the articles are generally spherical articles.

3. The article dispensing device of claim 1, wherein said path is defined by a series of inclined ramps, each ramp after a first of the ramps being inclined in a direction opposite to the inclination of the preceding ramp.

4. The article dispensing device of claim 1, wherein said means for enabling viewing comprises a window.

5. The article dispensing device of claim 1, wherein said means for possibly diverting said transferred article from said path comprises at least one element randomly traversing said path.

6. The article dispensing device of claim 5, wherein said means for possibly diverting said transferred article from said path comprises a plurality of elements randomly traversing said path.

7. The article dispensing device of claim 6, wherein each said randomly traversing elements are spaced along said path, and each randomly traversing element other than the first along the path traverses said path at a higher average rate of traversal than the preceding randomly traversing element.

8. The article dispensing device of claim 6, wherein each said randomly traversing element traverses said path at a higher average rate of traversal when the spherical article approaches said randomly traversing element than at other times.

9. The article dispensing device of claim 1, wherein said means responsive to said sensing means comprises means for actuating said transferring means to transfer a second article from said source to said starting point of said path and for activating said means for possibly diverting in order to possibly divert said second article from said path.

10. The article dispensing device of claim 1, wherein said means responsive to said sensing means comprises means for actuating an indicator.

11. The article dispensing means of claim 1, further comprising means for activating said means for transferring, said means for activating comprising a currency acceptor.

* * * * *